US012351421B2

(12) United States Patent
Yanagisawa

(10) Patent No.: US 12,351,421 B2
(45) Date of Patent: Jul. 8, 2025

(54) SHEET PROCESSING DEVICE

(71) Applicant: TOSHIBA TEC KABUSHIKI KAISHA, Tokyo (JP)

(72) Inventor: Naoki Yanagisawa, Sunto Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 172 days.

(21) Appl. No.: 18/107,534

(22) Filed: Feb. 9, 2023

(65) Prior Publication Data

US 2024/0270524 A1 Aug. 15, 2024

(51) Int. Cl.

*B65H 5/06* (2006.01)
*B65H 5/04* (2006.01)
*B65H 5/36* (2006.01)

(52) U.S. Cl.

CPC ..... *B65H 5/062* (2013.01); *B65H 5/04* (2013.01); *B65H 5/36* (2013.01); *B65H 2403/00* (2013.01); *B65H 2801/06* (2013.01)

(58) Field of Classification Search

CPC ..... B65H 5/36; B65H 2301/4127; B65H 2301/4477; B65H 2301/44921; B65H 2301/4435; B65H 2402/32; B65H 2404/6942

See application file for complete search history.

(56) References Cited

U.S. PATENT DOCUMENTS 7,837,196 B2 * 11/2010 Iguchi ..... B65H 29/60 271/298
7,931,268 B2 * 4/2011 Chagnon ..... B65H 45/18 271/182
8,033,539 B2 * 10/2011 Takai ..... B65H 29/22 270/58.11
8,061,701 B2 * 11/2011 Iguchi ..... B65H 37/04 270/32
2018/0370747 A1 12/2018 Dobashi et al.
2019/0250552 A1 8/2019 Sugiyama

FOREIGN PATENT DOCUMENTS

JP 2013-079122 5/2013

* cited by examiner

*Primary Examiner* — Howard J Sanders
(74) *Attorney, Agent, or Firm* — Amin, Turocy & Watson, LLP

(57) ABSTRACT

A sheet processing device in an embodiment includes a processing section, a tray, a lifting and lowering device, a flexible member, a first member, and a second member. The processing section processes a sheet. The sheet can be placed on a first surface on a first side of the tray. The lifting and lowering device moves the sheet to the processing section. The flexible member is provided on the first side of the tray and has flexibility. The first member is connected to a first end portion of the flexible member. The second member is connected to a second end portion opposite to the first end portion of the flexible member. The second member is separated from the first member in a first direction. A separation distance between the second member and the first member is shorter than length of the flexible member between the second member and the first member.

18 Claims, 7 Drawing Sheets

SHEET PROCESSING DEVICE

FIELD

Embodiments described herein relate generally to a sheet processing device and an image forming apparatus containing the sheet processing device.

BACKGROUND

A sheet processing device includes a processing section that processes a sheet and a tray on which the sheet can be placed. If the sheet is processed in a state in which creases occur on the sheet, processing quality is likely to be deteriorated. There has been a demand for a sheet processing device that can prevent deterioration in processing quality.

DETAILED DESCRIPTION

A sheet processing device in an embodiment includes a processing section, a tray, a lifting and lowering device, a flexible member, a first member, and a second member. The processing section processes a sheet. The sheet can be placed on a first surface on a first side of the tray. The lifting and lowering device moves the sheet to the processing section. The flexible member is provided on the first side of the tray and has flexibility. The first member is connected to a first end portion of the flexible member. The second member is connected to a second end portion opposite to the first end portion of the flexible member. The second member is separated from the first member in a first direction. A separation distance between the second member and the first member is shorter than length of the flexible member between the second member and the first member.

The sheet processing device in the embodiment is explained below with reference to the drawings.

Figure 1:
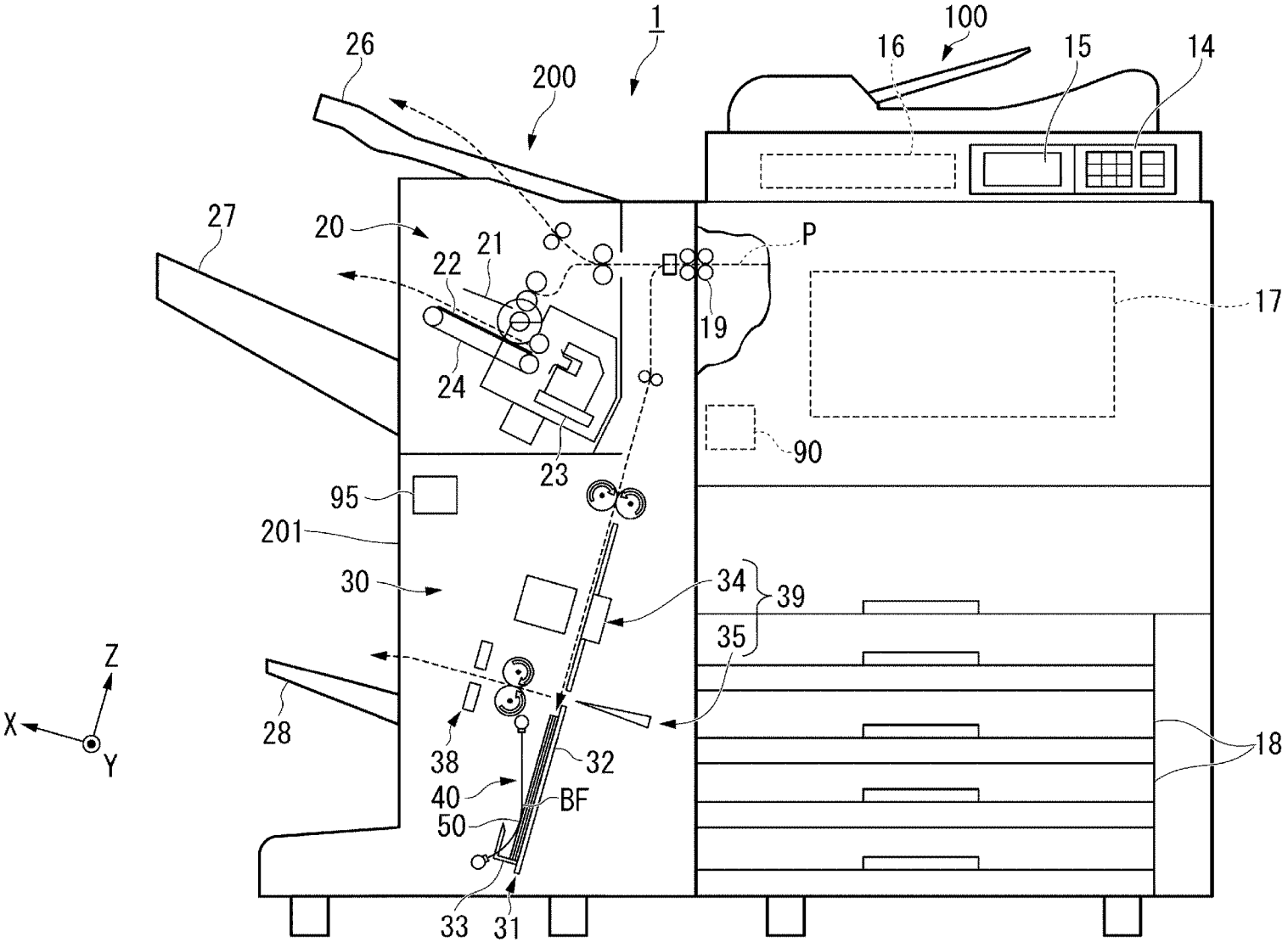
FIG. 1 is a schematic configuration diagram of an image forming apparatus.

FIG. 1 is a schematic configuration diagram of an image forming apparatus 1. For example, the image forming apparatus 1 is disposed in a workplace. The image forming apparatus 1 includes an image forming apparatus main body 100 and a sheet processing device 200. The image forming apparatus main body 100 and the sheet processing device 200 are disposed adjacent to each other.

The image forming apparatus main body 100 is explained.

The image forming apparatus main body 100 forms an image on a sheet (a recording medium) using a recording agent. The sheet is, for example, plain paper or label paper. A specific example of the recording agent is toner. The toner is toner used as a decolorable recording agent or toner used as a non-decolorable recording agent.

For example, the image forming apparatus main body 100 is a multifunction peripheral. As illustrated in FIG. 1, the image forming apparatus main body 100 includes a display section 15, an operation section 14, an image reading section 16, a printer section 17, sheet storing sections 18, a paper discharge roller 19, and a first control section 90.

The display section 15 is an image display device such as a liquid crystal display or an organic EL (Electro Luminescence) display. The display section 15 displays various kinds of information concerning the image forming apparatus main body 100 and the sheet processing device 200.

The operation section 14 includes a plurality of buttons. The operation section 14 receives operation of a user. The operation section 14 outputs a signal corresponding to the operation performed by the user to the first control section 90 of the image forming apparatus main body 100. The display section 15 and the operation section 14 may be configured as an integral touch panel.

The image reading section 16 reads image information of a reading target as brightness and darkness of light. The image reading section 16 outputs the read image information to the printer section 17.

The sheet storing sections 18 store sheets used for image formation. The sheet storing sections 18 supply the stored sheets to the printer section 17.

The printer section 17 forms an image on a sheet based on image information generated by the image reading section 16 or image information received via a communication path. The printer section 17 includes an image forming section, a transfer section, and a fixing device. The image forming section forms an electrostatic latent image on a photoconductive drum based on the image information. The image forming section causes toner to adhere to the electrostatic latent image and forms a visible image. The transfer section transfers the visible image onto the sheet. The fixing device heats and pressurizes the toner and fixes the visible image on the sheet.

The paper discharge roller 19 is disposed near a paper discharge port of the image forming apparatus main body 100. The paper discharge roller 19 delivers the sheet, on which the image is formed, to the sheet processing device 200.

Figure 2:
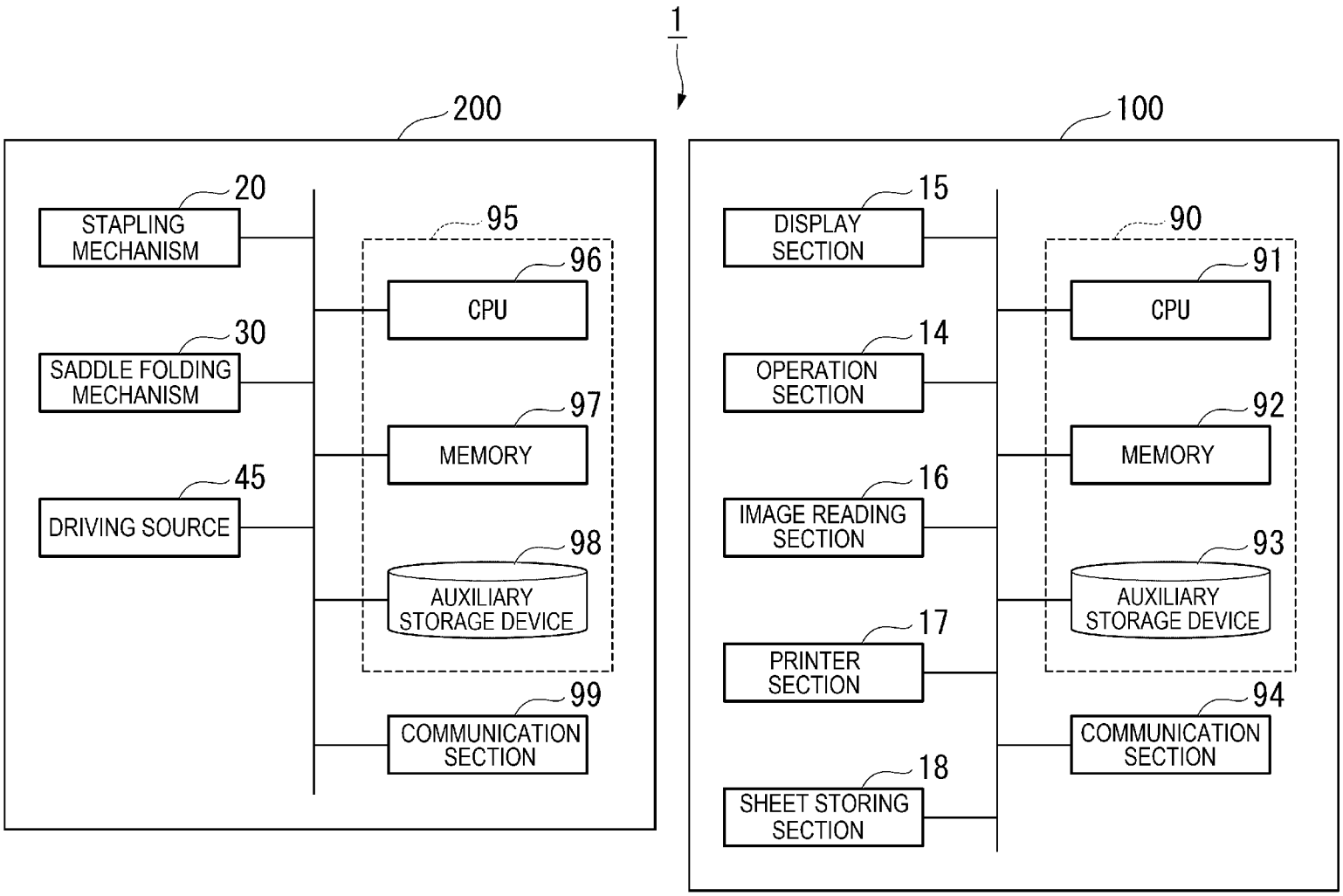
FIG. 2 is a block diagram illustrating a functional configuration example of the image forming apparatus.

FIG. 2 is a block diagram illustrating a functional configuration example of the image forming apparatus 1. The image forming apparatus main body 100 includes a CPU (Central Processing Unit) 91, a memory 92, and an auxiliary storage device 93 connected by a bus and executes a program. The image forming apparatus main body 100 executes the program to thereby function as a device including the display section 15, the operation section 14, the image reading section 16, the printer section 17, the sheet storing sections 18, and a communication section 94.

The CPU 91 executes a program stored in the memory 92 and the auxiliary storage device 93 to thereby function as the first control section 90. The first control section 90 controls operations of the sections of the image forming apparatus main body 100 and the sheet processing device 200.

The auxiliary storage device 93 is configured using a storage device such as a magnetic hard disk device or a semiconductor storage device. The auxiliary storage device 93 stores information.

The communication section 94 includes a communication interface for connecting the image forming apparatus main body 100 to an external device. The communication section 94 communicates with the external device via the communication interface.

The sheet processing device 200 is explained.

As illustrated in FIG. 1, the sheet processing device 200 applies post processing to a sheet P on which an image is formed. For example, the post processing is stapling or saddle folding. The sheet processing device 200 includes a stapling mechanism 20, a saddle folding mechanism 30, and a second control section (a control section) 95.

The stapling mechanism 20 includes a standby tray 21, a processing tray 22, and a stapler 23. The stapler 23 applies stapling to the peripheral edge portion of a plurality of sheets P. The stapled sheets P are conveyed by a conveyor belt 24 and discharged to a movable tray 27.

The sheet processing device 200 includes the movable tray 27 and an upper tray 26. The stapled sheets P are discharged to the movable tray 27. Unstapled sheets P are discharged to the upper tray 26.

First Embodiment

Figure 3:
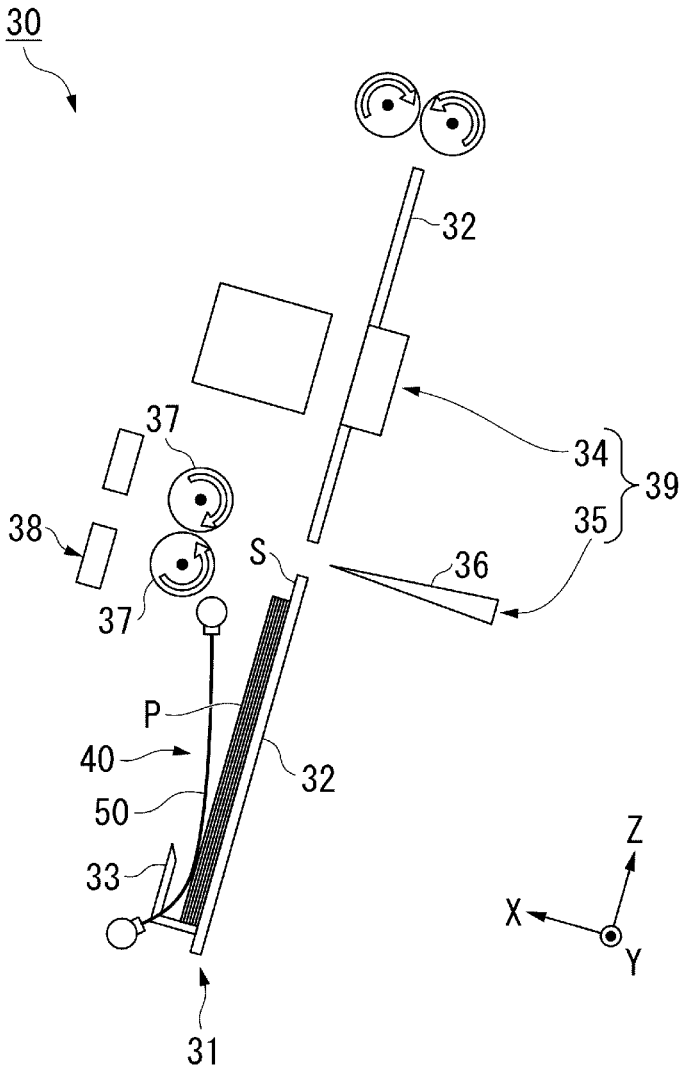
FIG. 3 is a front view of a saddle folding mechanism in a sheet processing device in a first embodiment.

FIG. 3 is a schematic configuration diagram of the saddle folding mechanism 30 in the sheet processing device 200 in a first embodiment.

The saddle folding mechanism 30 includes a sheet supporting section 31, a processing section 39, a lower tray 28 (see FIG. 1), and a pressing mechanism 40. The processing section 39 includes a folding section 35 and a stapling section 34.

The sheet supporting section 31 supports the sheet P. The sheet supporting section 31 includes a saddle folding tray 32 and lifting and lowering devices 33. The sheet P can be placed on a first surface S of the saddle folding tray 32. The lifting and lowering devices 33 move the sheet P to the processing section 39.

As a local coordinate system of the saddle folding mechanism 30, an X direction, a Y direction, and a Z direction of an orthogonal coordinate system are defined as follows. The X direction is the normal direction of the first surface S of the saddle folding tray 32. A +X direction is a direction in which the sheet P is placed on the saddle folding tray 32. The Z direction (a first direction) is a moving direction of the lifting and lowering devices 33. A +Z direction is a direction from the folding section 35 toward the stapling section 34. For example, the Y is the horizontal direction.

The saddle folding tray 32 has a substantially tabular shape. The sheet P can be placed on the first surface S in the +X direction of the saddle folding tray 32. The saddle folding tray 32 is present on both sides in the Z direction across the folding section 35.

Figure 4:
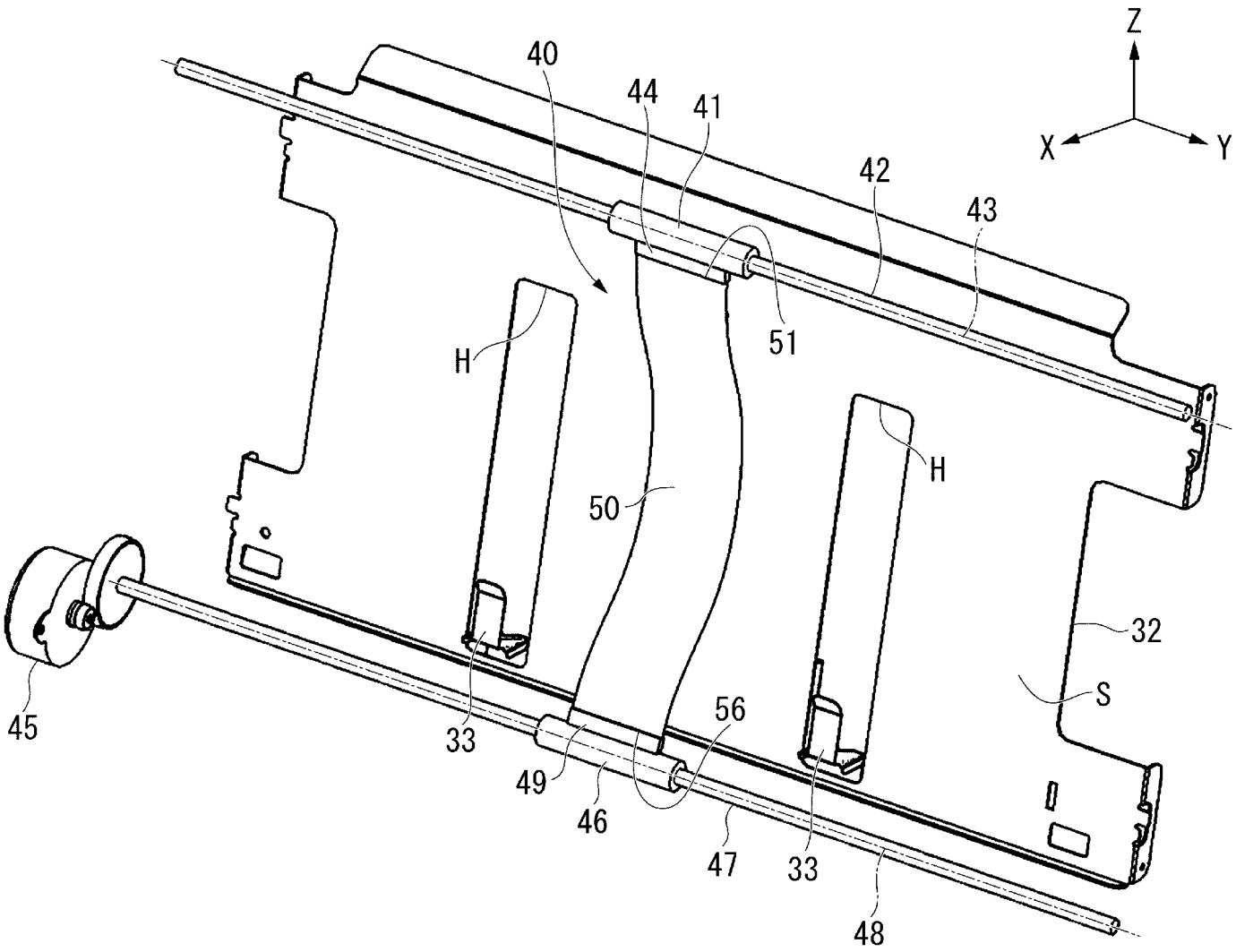
FIG. 4 is a perspective view of the periphery of a pressing mechanism.

FIG. 4 is a perspective view of the periphery of the pressing mechanism 40. The saddle folding tray 32 includes slits H that pierce through the saddle folding tray 32 in the X direction. The slits H extend in the Z direction. A pair of slits H is disposed to be separated in the Y direction.

The lifting and lowering devices 33 have a substantially L shape when viewed from the Y direction. The lifting and lowering devices 33 project in the +X direction from the slits H of the saddle folding tray 32. A pair of lifting and lowering devices 33 is disposed on the inner side of the slits H corresponding thereto. The pair of lifting and lowering devices 33 supports the end portion in a −Z direction of the sheet P. The lifting and lowering devices 33 can support a plurality of sheets P. The lifting and lowering devices 33 are movable in the Z direction along the slits H of the saddle folding tray 32. A moving mechanism for moving the lifting and lowering devices 33 is present in a −X direction of the saddle folding tray 32.

As illustrated in FIG. 3, the folding section 35 is present in the center of the saddle folding mechanism 30. The folding section 35 bends the center in the Z direction of the sheet P and forms a fold on the sheet P. The folding section 35 includes a blade 36, a pair of folding rollers 37, and an additional folding unit 38.

The blade 36 has a flat shape and is parallel to an XY plane. The blade 36 has a shape tapered in the +X direction. The blade 36 is movable in the X direction passing the saddle folding tray 32.

The pair of folding rollers 37 is present in the +X direction of the saddle folding tray 32. The pair of folding rollers 37 is disposed side by side in the Z direction. Rotation axes of the pair of folding rollers 37 are parallel to the Y direction.

The additional folding unit 38 is present in the +X direction of the pair of folding rollers 37. The additional folding unit 38 additionally folds the fold of the sheet P.

The stapling section 34 is present in the +Z direction of the folding section 35. The stapling section 34 applies stapling to a predetermined position of the sheet P. For example, the predetermined position of the sheet P is the center in the Z direction of the sheet P.

As illustrated in FIG. 1, the lower tray 28 is present in the +X direction of the additional folding unit 38 and in a lower part of the sheet processing device 200. The saddle-folded sheet P is discharged to the lower tray 28.

For example, the saddle folding mechanism 30 executes bookbinding of a plurality of sheets P. The sheet supporting section 31 supports the plurality of sheets P. The lifting and lowering devices 33 move the plurality of sheets P in the +Z direction. The lifting and lowering devices 33 dispose the center in the Z direction of the sheet P in the position of the stapling section 34. The stapling section 34 applies stapling to the plurality of sheets P. The lifting and lowering devices 33 move the plurality of sheets P in the −Z direction. The lifting and lowering devices 33 dispose the center in the Z direction of the sheet P in the position of the folding section 35. The blade 36 moves in the +X direction and pushes the sheet P into a space between the pair of folding rollers 37. The plurality of sheets P are saddle-folded in the center in the Z direction and a fold is formed on the plurality of sheets P. The additional folding unit 38 additionally folds the fold of the plurality of sheets P. Consequently, the bookbinding of the plurality of sheets P is completed. The bound plurality of sheets P are discharged to the lower tray 28.

The sheet processing device 200 includes a CPU (Central Processing Unit) 96, a memory 97, and an auxiliary storage device 98 connected by a bus as illustrated in FIG. 2 and executes a program. The sheet processing device 200 executes the program to thereby function as a device including the stapling mechanism 20, the saddle folding mechanism 30, a driving source 45, and a communication section 99.

The CPU 96 executes a program stored in the memory 97 and the auxiliary storage device 98 to thereby function as a second control section (a control section) 95. The second control section 95 controls operations of the sections of the sheet processing device 200.

The auxiliary storage device 98 is configured using a storage device such as a magnetic hard disk device or a semiconductor storage device. The auxiliary storage device 98 stores information.

The communication section 99 includes a communication interface for connecting the sheet processing device 200 to an external device. The communication section 99 communicates with the external device via the communication interface.

The pressing mechanism 40 is explained.

Figure 5:
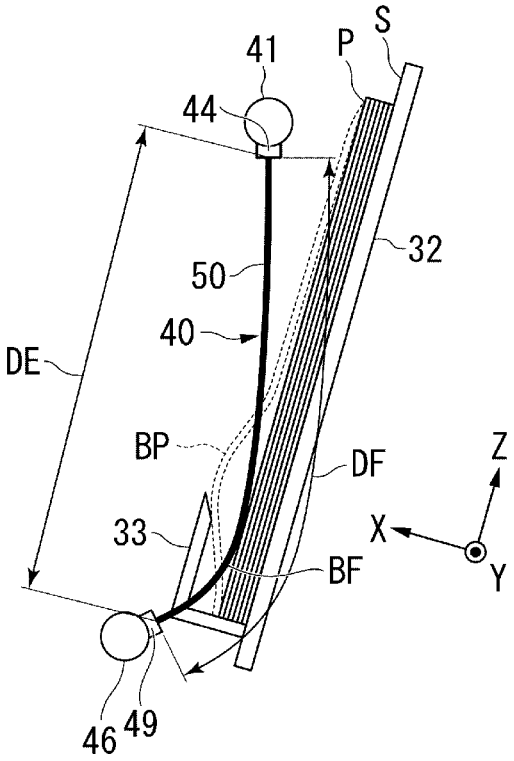
FIG. 5 is a front view of the periphery of the pressing mechanism.

FIG. 5 is a front view of the periphery of the pressing mechanism 40. An angle between the X direction, which is the normal direction of the saddle folding tray 32, and the horizontal direction is smaller than an angle between the X direction and the vertical direction. The first surface S of the saddle folding tray 32 is closer to the vertical plane than the horizontal plane. The sheet P is placed to lean against the first surface S of the saddle folding tray 32. Deflection BP easily occurs in the lower half portion of the sheet P placed on the saddle folding tray 32. The pressing mechanism 40 presses the deflection BP of the sheet P and prevents the occurrence of the deflection BP.

The pressing mechanism 40 is present in the +X direction of the saddle folding tray 32. The pressing mechanism 40 is present in the −Z direction of the folding section 35. The pressing mechanism 40 includes a flexible member 50, a first member 41, and a second member 46.

The flexible member 50 is formed by a material having flexibility such as a resin film. A film having conductivity may be formed on the surface of the flexible member 50. The film may be grounded. The flexible member 50 may be formed by a metal belt having conductivity. The flexible member 50 may be grounded. Electrostatic charging of the flexible member 50 is prevented and attraction of the flexible member 50 and the sheet P is prevented.

The flexible member 50 illustrated in FIG. 4 has a rectangular flat shape in a state in which the flexible member 50 is not connected to the first member 41 and the second member 46. The longitudinal direction of the flexible member 50 extends in the Z direction and the latitudinal direction of the flexible member 50 extends in the Y direction. The flexible member 50 is opposed to the center in the Y direction of the saddle folding tray 32. The flexible member 50 is present between the pair of lifting and lowering devices 33 in the Y direction. Interference between the lifting and lowering devices 33 moving in the Z direction and the flexible member 50 is avoided.

The first member 41 has a cylindrical shape. A first shaft 42 is disposed on the inner side of the first member 41. The first member 41 and the first shaft 42 are capable of turning (freely turn) around a first turning axis 43. The first turning axis 43 is parallel to the Y direction. The length in the Y direction of the first member 41 is equal to or larger than the length in the Y direction of the flexible member 50. The length in the Y direction of the first shaft 42 is equal to or larger than the length in the Y direction of the saddle folding tray 32. Both the end portions in the Y direction of the first shaft 42 are turnably supported. The posture of the first member 41 changes according to the turning.

The first member 41 is separated in the +X direction from the first surface S of the saddle folding tray 32. The first member 41 includes a first connecting section 44. The first connecting section 44 is present in the outer circumference of the first member 41. The first connecting section 44 is connected to the edge of a first end portion 51 in the +Z direction of the flexible member 50.

The second member 46 has a cylindrical shape. A second shaft 47 is disposed on the inner side of the second member 46. The second member 46 and the second shaft 47 are capable of turning around a second turning axis 48. The second turning axis 48 is parallel to the Y direction. The length in the Y direction of the second member 46 is equal to or larger than the length in the Y direction of the flexible member 50. The length in the Y direction of the second shaft 47 is equal to or larger than the length in the Y direction of the saddle folding tray 32. Both the end portions in the Y direction of the second shaft 47 are turnably supported. The posture of the second member 46 changes according to the turning.

The driving source 45 is present at one end portion in the Y direction of the second shaft 47. For example, the driving source 45 is a motor. The driving source 45 turns the second member 46 via the second shaft 47. The second control section 95 (see FIG. 2) controls operation of the driving source 45. The second control section 95 controls the posture of the second member 46.

The second member 46 is separated in the +X direction from the first surface S of the saddle folding tray 32. The second member 46 includes a second connecting section 49. The second connecting section 49 is present in the outer circumference of the second member 46. The second connecting section 49 is connected to the edge of a second end portion 56 in the −Z direction of the flexible member 50.

As illustrated in FIG. 5, the first member 41 and the second member 46 are separated in the Z direction. A separation distance between the first connecting section 44 of the first member 41 and the second connecting section 49 of the second member 46 is represented as DE. The length (the length of a chord) of the flexible member 50 between the first connecting section 44 of the first member 41 and the second connecting section 49 of the second member 46 is represented as DF. The separation distance DE between the first member 41 and the second member 46 is shorter than the length DF of the flexible member 50. Deflection BF in the X direction is formed in the flexible member 50.

The second control section 95 controls the operation of the driving source 45, whereby the second member 46 turns by a predetermined angle. The first member 41 freely turns. Consequently, the position in the Z direction of the deflection BF of the flexible member 50 changes.

Action of the pressing mechanism 40 is explained.

The user of the image forming apparatus 1 illustrated in FIG. 1 inputs a command to the operation section 14 of the image forming apparatus main body 100. For example, the user inputs a command for forming images on a plurality of sheets P and executing bookbinding of the plurality of sheets P. The first control section 90 of the image forming apparatus main body 100 transmits size information of the sheet P to the second control section 95 of the sheet processing device 200. The second control section 95 moves the lifting and lowering devices 33 based on the received size information of the sheet P. If the size of the sheet P is large, the second control section 95 moves the lifting and lowering devices 33 to near the end portion in the −Z direction of the saddle folding tray 32.

The second control section 95 turns the second member 46 and reverses the deflection BF of the flexible member 50 in the +X direction of the first member 41 and the second member 46. Gaps are formed between the first member 41 and the second member 46 and the saddle folding tray 32.

The sheet P on which an image is formed in the image forming apparatus main body 100 is conveyed to the saddle folding mechanism 30 of the sheet processing device 200. Since the deflection BF of the flexible member 50 is moved in the +X direction, interference between the flexible member 50 and the sheet P is avoided. The sheet P is supported by the saddle folding tray 32 and the lifting and lowering devices 33 of the sheet supporting section 31.

As illustrated in FIG. 5, the deflection BP sometimes occurs in the sheet P. The second control section 95 turns the second member 46 and reverses the deflection BF of the flexible member 50 in the −X direction of the first member 41 and the second member 46. The deflection BF of the flexible member 50 presses the deflection BP of the sheet P to eliminate the deflection BP. The second control section 95 presses the sheet P with the flexible member 50 irrespective of presence or absence of occurrence of the deflection BP. A sensor or the like that detects occurrence of the deflection BP is unnecessary. Cost of the sheet processing device 200 is reduced. If the second control section 95 turns the second member 46, a projection amount of the deflection BF in the −X direction from the first member 41 and the second member 46 changes. The second control section 95 may adjust the projection amount of the deflection BF according to the number of sheets P placed on the saddle folding tray 32.

The deflection BP occurs in the lower half portion of the sheet P because of the own weight of the sheet P. In the memory 97 of the second control section 95, positions in the Z direction where the deflection BP occurs are recorded in advance for each of sizes of the sheets P. The second control section 95 reads out the position of the deflection BP of the sheet P from the memory 97 based on the size information of the sheet P. The second control section 95 turns the second member 46 and adjusts the position in the Z direction of the deflection BF of the flexible member 50. The second control section 95 causes the position of the deflection BF of the flexible member 50 to coincide with or approach the position of the deflection BP of the sheet P. The deflection BP is effectively eliminated.

Figure 6:
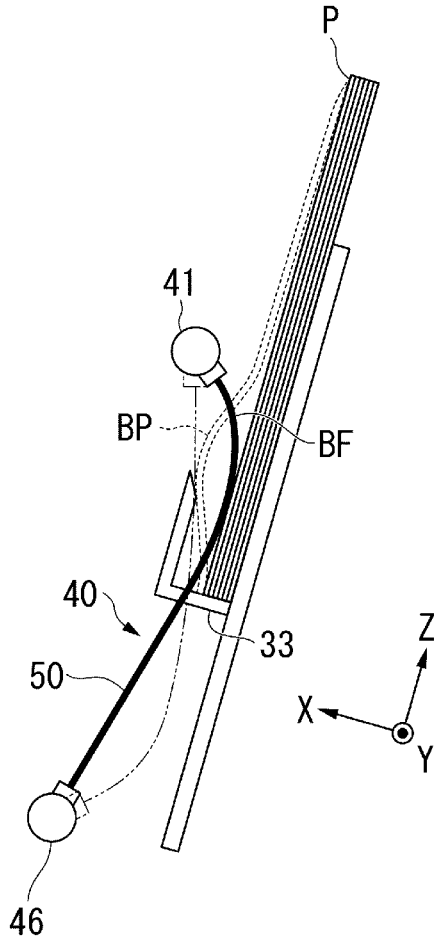
FIG. 6 is an explanatory diagram of action of the pressing mechanism.

FIG. 6 is an explanatory diagram of action of the pressing mechanism. If the size of the sheet P is small, the second control section 95 disposes the lifting and lowering devices 33 further in the +Z direction than the position illustrated in FIG. 5 and waits for arrival of the sheet P. The second control section 95 adjusts the position in the Z direction of the deflection BF of the flexible member 50 based on the position information and the size information of the sheet P. The second control section 95 turns the second member 46 and causes the deflection BF of the flexible member 50 to occur further in the +Z direction than the position illustrated in FIG. 5. The deflection BP of the sheet P is eliminated irrespective of the position and the size of the sheet P.

The second control section 95 drives the lifting and lowering devices 33 and moves the sheet P in the +Z direction. The second control section 95 moves the center in the Z direction of the sheet P to the position of the stapling section 34 illustrated in FIG. 3. Since the deflection BP of the sheet P is eliminated before the movement to the stapling section 34, the deflection BP is less likely to occur again during the movement. The stapling section 34 can apply stapling to the center in the Z direction of the sheet P. Deterioration in processing quality of the sheet processing device 200 is prevented.

The second control section 95 may move the deflection BF of the flexible member 50 in the +Z direction according to the movement in the +Z direction of the sheet P. The second control section 95 turns the second member 46 and continuously moves the deflection BF of the flexible member 50 from the position illustrated in FIG. 5 to the position illustrated in FIG. 6. The deflection BP during the movement of the sheet P is prevented from occurring again. Deterioration in processing quality of the sheet processing device 200 is prevented.

As explained in detail above, the sheet processing device 200 in the embodiment includes the processing section 39, the saddle folding tray 32, the lifting and lowering devices 33, the flexible member 50, the first member 41, and the second member 46. The processing section 39 processes the sheet P. The sheet P can be placed on the first surface S in the +X direction of the saddle folding tray 32. The lifting and lowering devices 33 move the sheet P to the processing section 39. The flexible member 50 is present in the +X direction of the saddle folding tray 32 and has flexibility. The first member 41 is connected to the first end portion 51 of the flexible member 50. The second member 46 is connected to the second end portion 56 opposite to the first end portion 51 of the flexible member 50. The second member 46 is separated in the Z direction from the first member 41. The separation distance DE between the second member 46 and the first member 41 is shorter than the length DF of the flexible member 50 between the second member 46 and the first member 41.

The deflection BF in the X direction is formed in the flexible member 50. The deflection BF of the flexible member 50 presses the deflection BP of the sheet P to eliminate the deflection BP. The stapling section 34 can apply stapling to a predetermined position of the sheet P. Deterioration in processing quality of the sheet processing device 200 is prevented.

The sheet processing device 200 further includes the driving source 45 and the second control section 95. The driving source 45 causes the second member 46 to operate. The second control section 95 controls the operation of the driving source 45.

The second control section 95 causes the second member 46 to operate and adjusts the position in the Z direction of the deflection BF of the flexible member 50. The deflection BP of the sheet P is eliminated irrespective of the position and the size of the sheet P.

The first member 41 is capable of turning around the first turning axis 43 parallel to the first surface S and orthogonal to the Z direction. The second member 46 is capable of turning around the second turning axis 48 parallel to the first turning axis 43.

The second control section 95 turns the second member 46, whereby the position in the Z direction of the deflection BF of the flexible member 50 changes. The deflection BP of the sheet P is eliminated irrespective of the position and the size of the sheet P.

The Z direction is parallel to the moving direction of the lifting and lowering devices 33.

The first member 41 and the second member 46 are separated in the moving direction of the lifting and lowering devices 33. The flexible member 50 is continuously deflected between the first member 41 and the second member 46. The sheet P can be moved by the lifting and lowering devices 33 in a state in which the sheet P is pressed by the deflection BF of the flexible member 50.

The flexible member 50 is disposed side by side with the lifting and lowering devices 33 in the Y direction orthogonal to the moving direction of the lifting and lowering devices 33.

Interference between the moving lifting and lowering devices 33 and the flexible member 50 is avoided.

Modifications of the First Embodiment

In the first embodiment, the first member 41 freely turns around the first turning axis 43. The posture of the first member 41 changes according to the turning. The second member 46 is capable of turning around the second turning axis 48. The driving source 45 turns the second member 46. The driving source 45 controls the posture of the second member 46.

In a first modification of the first embodiment, the first member 41 freely moves in the Z direction. The position in the Z direction of the first member 41 changes according to the movement. The second member 46 is capable of turning around the second turning axis 48. The second member 46 is capable of turning around the second turning axis 48 parallel to the first surface S and orthogonal to the Z direction. The driving source 45 turns the second member 46.

In a second modification of the first embodiment, a relative position of the first member 41 with respect to the saddle folding tray 32 is fixed. The position and the posture of the first member 41 do not change. The second member 46 is capable of turning around the second turning axis 48. The second member 46 is capable of turning around the second turning axis 48 parallel to the first surface S and orthogonal to the Z direction. The driving source 45 turns the second member 46.

In a third modification of the first embodiment, the first member 41 freely turns around the first turning axis 43. The second member 46 is movable in the Z direction. The driving source 45 moves the second member 46 in the Z direction via a rack and pinion mechanism or the like. The driving source 45 controls the position in the Z direction of the second member 46.

In a fourth modification of the first embodiment, a relative position of the first member 41 with respect to the saddle folding tray 32 is fixed. The second member 46 is movable in the Z direction. The driving source 45 moves the second member 46 in the Z direction.

In a fifth modification of the first embodiment, the first member 41 freely moves in the Z direction. The second member 46 is movable in the Z direction. The driving source 45 moves the second member 46 in the Z direction.

In the first to fifth modifications as well, the second control section 95 causes the second member 46 to operate via the driving source 45, whereby the position in the Z direction of the deflection BF of the flexible member 50 changes. The deflection BP of the sheet P is eliminated irrespective of the position and the size of the sheet P. The stapling section 34 can apply stapling to a predetermined position of the sheet P. Deterioration in processing quality of the sheet processing device 200 is prevented.

Second Embodiment

Figure 7:
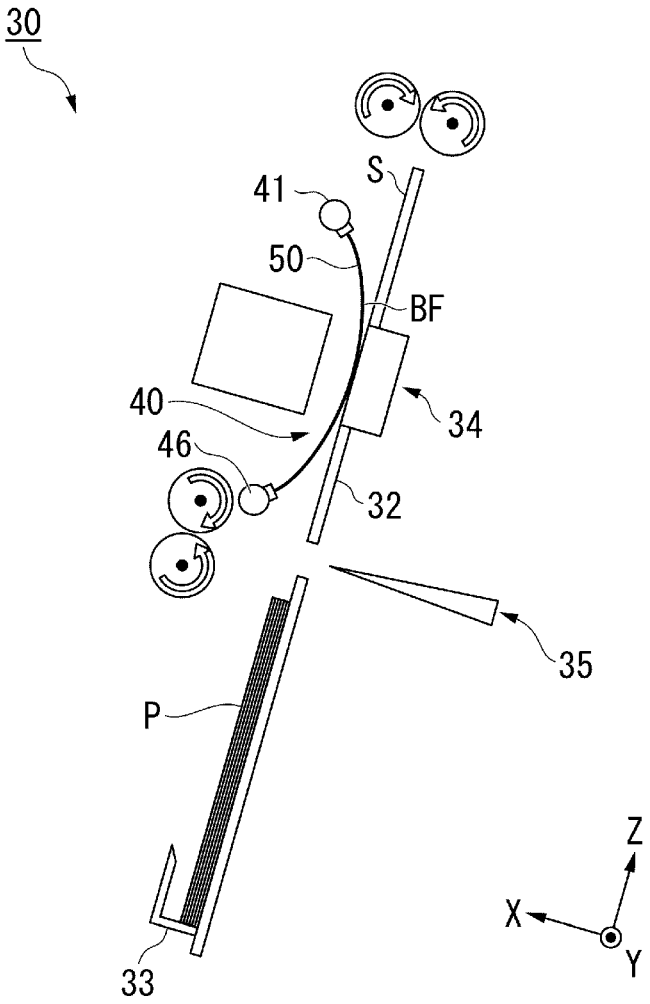
FIG. 7 is a front view of a saddle folding mechanism in a sheet processing device in a second embodiment.

FIG. 7 is a front view of the saddle folding mechanism 30 in the sheet processing device 200 in a second embodiment. In the saddle folding mechanism 30 in the first embodiment illustrated in FIG. 3, the pressing mechanism 40 is present in the −Z direction of the folding section 35. In the saddle folding mechanism 30 in the second embodiment illustrated in FIG. 7, the pressing mechanism 40 is present in the +Z direction of the folding section 35. Explanation of the second embodiment concerning the same portions as the portions in the first embodiment is sometimes omitted.

The pressing mechanism 40 is present in the +Z direction of the folding section 35. The pressing mechanism 40 is present in the position of the stapling section 34 in the Z direction. A configuration of the pressing mechanism 40 is the same as the configuration in the first embodiment. The configuration of the pressing mechanism 40 may be the same as the configurations in the first to fifth modifications of the first embodiment.

The second control section 95 causes the lifting and lowering devices 33 to move the sheet P to the position of the stapling section 34. The second control section 95 turns the second member 46 and presses the sheet P with the deflection BF of the flexible member 50. The deflection BP of the sheet P is eliminated.

In the second embodiment, after the movement of the sheet P, the sheet P is pressed by the flexible member 50 immediately before stapling. Even if the deflection BP occurs during the movement of the sheet P, the deflection BP is eliminated in the stapling section 34. The stapling section 34 can apply the stapling to a predetermined position of the sheet P. Deterioration in processing quality of the sheet processing device 200 is prevented.

The pressing mechanism 40 in the first embodiment is present in the −Z direction of the folding section 35. The pressing mechanism 40 in the second embodiment is present in the +Z direction of the folding section 35. The pressing mechanism 40 may be present in both of the −Z direction and the +Z direction of the folding section 35.

The first member 41 and the second member 46 in the embodiments and the modifications are separated in the Z direction. The first member 41 and the second member 46 may be separated in another direction.

The first turning axis 43 and the second turning axis 48 in the embodiments and the modifications are parallel to the Y direction. The first turning axis 43 and the second turning axis 48 may be parallel to another direction. The first turning axis 43 and the second turning axis 48 may not be parallel to each other.

The driving source 45 in the embodiments and the modifications causes the second member 46 to operate. The driving source 45 may cause the first member 41 to operate. The driving source 45 may cause both of the first member 41 and the second member 46 to operate.

According to at least one of the embodiments explained above, the sheet processing device 200 includes the second member 46. The separation distance DE between the second member 46 and the first member 41 is shorter than the length DF of the flexible member 50 between the second member 46 and the first member 41. Consequently, deterioration in processing quality of the sheet processing device 20 can be prevented.

While certain embodiments have been described these embodiments have been presented by way of example only, and are not intended to limit the scope of the inventions. Indeed, the novel embodiments described herein may be embodied in a variety of other forms: furthermore various omissions, substitutions and changes in the form of the embodiments described herein may be made without departing from the spirit of the inventions. The accompanying claims and there equivalents are intended to cover such forms or modifications as would fall within the scope and spirit of the invention.

What is claimed is:

1. A sheet processing device, comprising:

a processing section configured to process a sheet;

a tray on a first surface on a first side of which the sheet is placed;

a lifting and lowering device configured to move the sheet to the processing section;

a single flexible member having flexibility and provided on the first side of the tray;

a first member connected to a first end portion of the single flexible member;

a second member connected to a second end portion opposite to the first end portion of the single flexible member and separated from the first member in a first direction, a separation distance between the second member and the first member being shorter than length of the single flexible member between the second member and the first member;

a driving source configured to cause the second member to operate; and a controller configured to control operation of the driving source.

2. The sheet processing device according to claim 1, wherein the first member is configured to turn around a first turning axis parallel to the first surface and orthogonal to the first direction, and the second member is configured to turn around a second turning axis parallel to the first turning axis.

3. The sheet processing device according to claim 1, wherein the first member is movable, and the second member is configured to turn around a second turning axis parallel to the first surface and orthogonal to the first direction.

4. The sheet processing device according to claim 1, wherein a relative position of the first member with respect to the tray is fixed, and the second member is configured to turn around a second turning axis parallel to the first surface and orthogonal to the first direction.

5. The sheet processing device according to claim 1, wherein the first member is configured to turn around a first turning axis parallel to the first surface and orthogonal to the first direction, and the second member is movable.

6. The sheet processing device according to claim 1, wherein a relative position of the first member with respect to the tray is fixed, and the second member is movable.

7. The sheet processing device according to claim 1, wherein the first member is movable, and the second member is movable.

8. The sheet processing device according to claim 1, wherein the first direction is parallel to a moving direction of the lifting and lowering device.

9. The sheet processing device according to claim 1, wherein the single flexible member is disposed side by side with the lifting and lowering device in a second direction orthogonal to a moving direction of the lifting and lowering device.

10. An image forming apparatus, comprising:

an image forming component; and a sheet processing device, comprising:

a processing section configured to process a sheet;

a tray on a first surface on a first side of which the sheet is placed;

a lifting and lowering device configured to move the sheet to the processing section;

a single flexible member having flexibility and provided on the first side of the tray;

a first member connected to a first end portion of the single flexible member;

a second member connected to a second end portion opposite to the first end portion of the single flexible member and separated from the first member in a first direction, a separation distance between the second member and the first member being shorter than length of the single flexible member between the second member and the first member;

a driving source configured to cause the second member to operate; and a controller configured to control operation of the driving source.

11. The image forming apparatus according to claim 10, wherein the first member is configured to turn around a first turning axis parallel to the first surface and orthogonal to the first direction, and the second member is configured to turn around a second turning axis parallel to the first turning axis.

12. The image forming apparatus according to claim 10, wherein the first member is movable, and the second member is configured to turn around a second turning axis parallel to the first surface and orthogonal to the first direction.

13. The image forming apparatus according to claim 10, wherein a relative position of the first member with respect to the tray is fixed, and the second member is configured to turn around a second turning axis parallel to the first surface and orthogonal to the first direction.

14. The image forming apparatus according to claim 10, wherein the first member is configured to turn around a first turning axis parallel to the first surface and orthogonal to the first direction, and the second member is movable.

15. The image forming apparatus according to claim 10, wherein a relative position of the first member with respect to the tray is fixed, and the second member is movable.

16. The image forming apparatus according to claim 10, wherein the first member is movable, and the second member is movable.

17. The image forming apparatus according to claim 10, wherein the first direction is parallel to a moving direction of the lifting and lowering device.

18. The image forming apparatus according to claim 10, wherein the single flexible member is disposed side by side with the lifting and lowering device in a second direction orthogonal to a moving direction of the lifting and lowering device.

* * * * *